United States Patent [19]

McCabe

[11] 4,270,818

[45] Jun. 2, 1981

[54] POWER WINDING PAPER TOWEL DISPENSER

[76] Inventor: Stanley G. McCabe, 4630 55th Dr. #185, Lubbock, Tex. 79414

[21] Appl. No.: 26,040

[22] Filed: Apr. 2, 1979

[51] Int. Cl.[3] ..... B65H 19/00

[52] U.S. Cl. ..... 312/38; 312/39; 312/45; 242/55.53

[58] Field of Search ..... 312/38, 39, 40, 37, 312/45; 242/55.53

[56] References Cited

U.S. PATENT DOCUMENTS

| | | | |
|---|---|---|---|
| 1,304,595 | 5/1919 | Peterson | 312/38 |
| 1,410,068 | 3/1922 | Marshall et al. | 312/38 |
| 1,756,822 | 4/1930 | Hails | 312/38 |
| 1,756,839 | 4/1930 | Steiner et al. | 312/38 |
| 1,765,505 | 6/1930 | Steiner et al. | 312/38 |
| 1,788,962 | 1/1931 | Steiner | 312/38 |
| 1,898,796 | 2/1933 | Steiner et al. | 312/38 |
| 1,916,542 | 7/1933 | Trewhitt et al. | 312/38 |
| 2,295,955 | 9/1942 | Page | 312/38 |
| 2,930,663 | 3/1960 | Weiss | 312/38 |
| 3,127,121 | 3/1964 | Babin | 242/55.53 |
| 3,301,617 | 1/1967 | Goodwin et al. | 312/39 |
| 3,574,431 | 4/1971 | Henderson | 312/38 |
| 3,826,548 | 7/1974 | Schnyder et al. | 312/38 |
| 3,858,951 | 1/1975 | Rasmussen | 312/38 |
| 3,858,952 | 1/1975 | Bahnsen | 312/38 |
| 3,920,294 | 11/1975 | Kullik | 312/38 |
| 3,971,607 | 7/1976 | Schnyder | 312/38 |

*Primary Examiner*—Victor N. Sakran

*Attorney, Agent, or Firm*—Hill, Van Santen, Steadman, Chiara & Simpson

[57] ABSTRACT

Dispenser for rolls of paper toweling of standard size and width, accommodating withdrawal of clean roll toweling from a cabinet for use and rolling the spent toweling in a spent towel compartment in the cabinet, for disposal. The roll of clean toweling is inserted in the cabinet from the top and rests on an inclined divider plate separating a clean towel compartment from the spent towel compartment and also bears against a rear wall of the cabinet. The clean toweling is drawn from the cabinet along the divider plate and passed over a sensing switch which establishes an energizing circuit to a winding motor under the control of a limit switch energizing the winding motor upon withdrawal of the toweling and after a time delay sufficient to dry the hands. The clean toweling, as unrolled, passes out of the cabinet through a slot at the top of a recessed portion of the front of the cabinet for use. The used toweling extends through a slot spaced beneath the first slot into the spent towel compartment and is connected at its free end to a spindle. In passing into the cabinet, the spent toweling passes along the arm of a normally closed limit switch, and when under tension, opens the switch to deenergize a drive motor for the spindle. The spent toweling is wound on the spindle, as the motor is energized and the spindle is releasably coupled to the motor. The top of the cabinet is hinged to afford access to the clean towel compartment to insert a roll of clean toweling in the compartment while the front wall of the cabinet is hinged to afford access to the spent towel compartment.

10 Claims, 5 Drawing Figures

Fig. 3
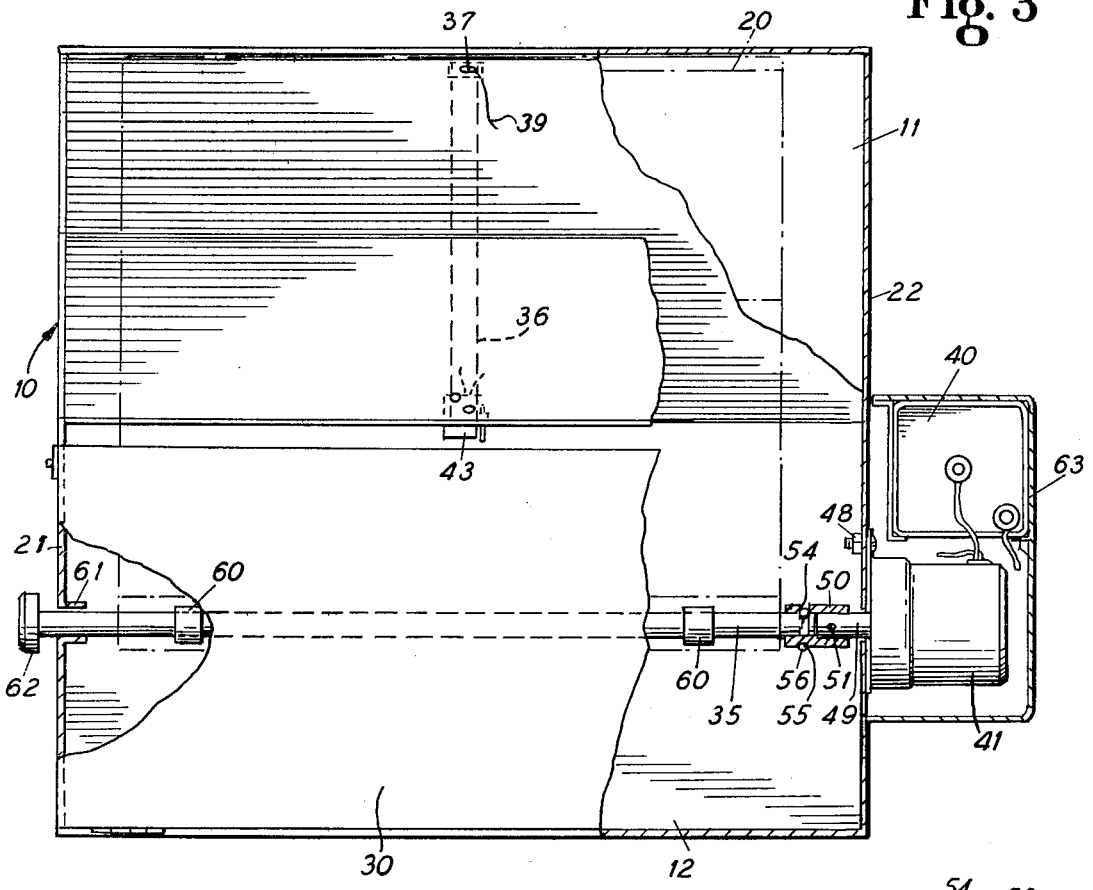
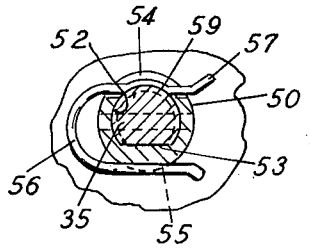
Fig. 4
Fig. 5
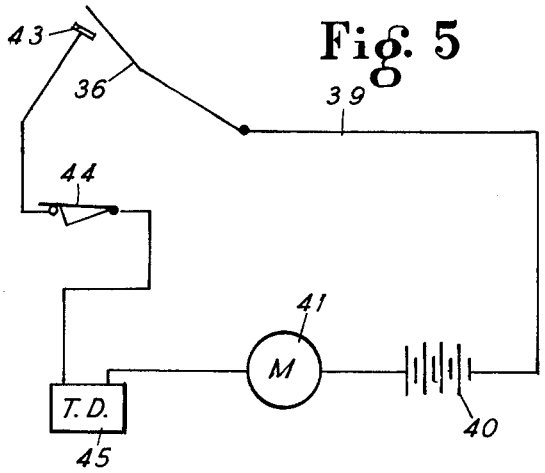

POWER WINDING PAPER TOWEL DISPENSER

BACKGROUND, SUMMARY AND ADVANTAGES OF INVENTION

My prior U.S. application Ser. No. 884,901, filed Mar. 9, 1978, the claims of which are allowable and Official Notice of Allowance is expected, is directed to a paper towel dispenser particularly adapted for nylon reinforced paper toweling in which the toweling is drawn from a roll through a pressure nip operated by withdrawal force on the toweling and returned to the cabinet through another pressure nip driven from the means establishing the first pressure nip, to be compacted in the bottom of the cabinet for removal. Such dispensers have been found to be very satisfactory for nylon reinforced rolls of toweling, but when rolls of commercial paper toweling, supplied to the public in stores is used, the paper cannot stand the pulling thereon and frequently tears. Moreover, nylon toweling is considerably more expensive than roll toweling used for household purposes and is not readily available in the average store.

The paper towel dispenser of the present invention differs from that of my prior application in that it is particularly adapted for rolls of paper toweling of commercial weight, which may be of various commercial grades and widths, but which will readily fit within the cabinet and is an improvement upon previous towel dispensers in its simplicity and low cost and the fact that the spent, damp paper toweling is rolled on a spindle by power independently of the unrolling of the paper toweling, and a minimum strain is placed on the toweling as drawn from the cabinet for use. It further improves upon the towel dispensers known in that the dirty toweling is drawn into the spent towel compartment of the cabinet under the control of a limit switch, energizing a motor to wind in the spent toweling in a predetermined time delay interval after closing of the switch, sufficient to permit drying of the hands or face or both with no attention from the user to the toweling. The clean toweling merely rests on an inclined plate in a back wall of the cabinet and is sensed by a sensing switch sufficiently sensitive to close by the weight of the paper on the inclined plate, as the toweling is pulled from the cabinet and is returned to the cabinet through a slot under the control of a limit or time delay switch energized by the tension of the toweling as the toweling is drawn from the cabinet for use and energizing a winding motor in a predetermined time interval to wind up the spent toweling and draw the clean toweling taut across the front of the cabinet.

A principal advantage of the present invention is that commercial roll toweling may be unrolled from a cabinet for use and the used toweling may be rolled into a separate spent towel compartment in the cabinet for disposal when the roll of toweling is used up.

A further advantage in the invention is in the simplicity and positiveness in action of the roll towel dispenser of the present invention adapted for various commercial grades of roll paper toweling and accommodating use of the toweling and returning of the toweling to a spent towel compartment of the cabinet with a minimum amount of strain on the toweling.

A further advantage in the invention is in the positiveness in action of the roll toweling dispenser of the present invention in which the spent toweling is wound in the form of the roll in the bottom of the dispensing cabinet as used, and the power for returning the towel to the cabinet is of a simplified form requiring no attention other than drawing of the toweling from the cabinet for use.

A further advantage of the invention is in the efficiency in operation of the paper towel dispenser of the present invention, in which the toweling is available for use for a predetermined time interval after drawing from the cabinet and is returned to the cabinet into a compartment separated from the roll of clean toweling and rolled in the form of a roll at the termination of this time interval.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF THE DRAWINGS

FIG. 3 is a plan view of the dispenser with certain parts broken away and certain other parts shown in section;

FIG. 4 is a fragmentary sectional view illustrating the motor coupling and the connection from the motor coupling to the winding spindle of the dispenser, winding the spent toweling thereon; and FIG. 5 is a schematic wiring diagram schematically illustrating the energizing circuit to the winding motor for drawing the spent toweling into the cabinet.

DESCRIPTION OF PREFERRED EMBODIMENT OF INVENTION

Figure 1:
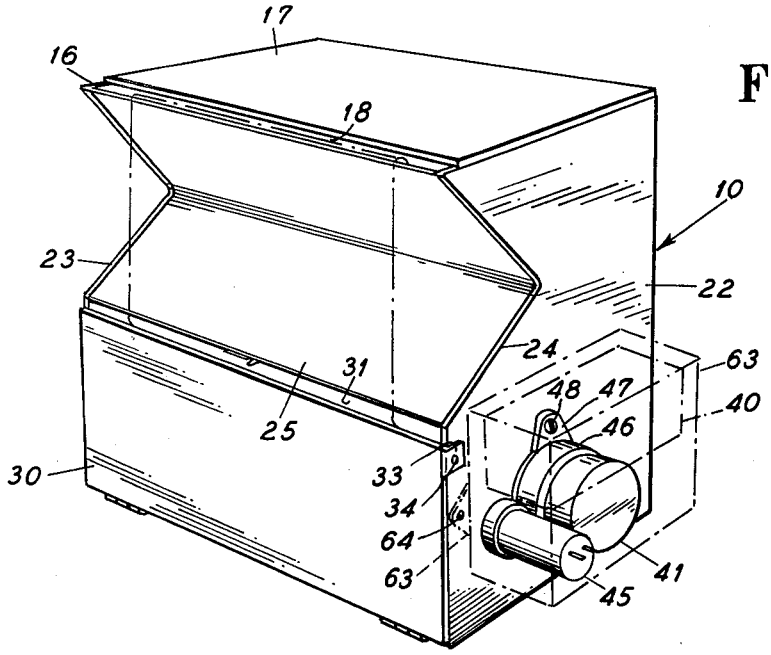
FIG. 1 is a generally perspective view of a paper towel dispenser constructed in accordance with the principles of the present invention.
Figure 2:
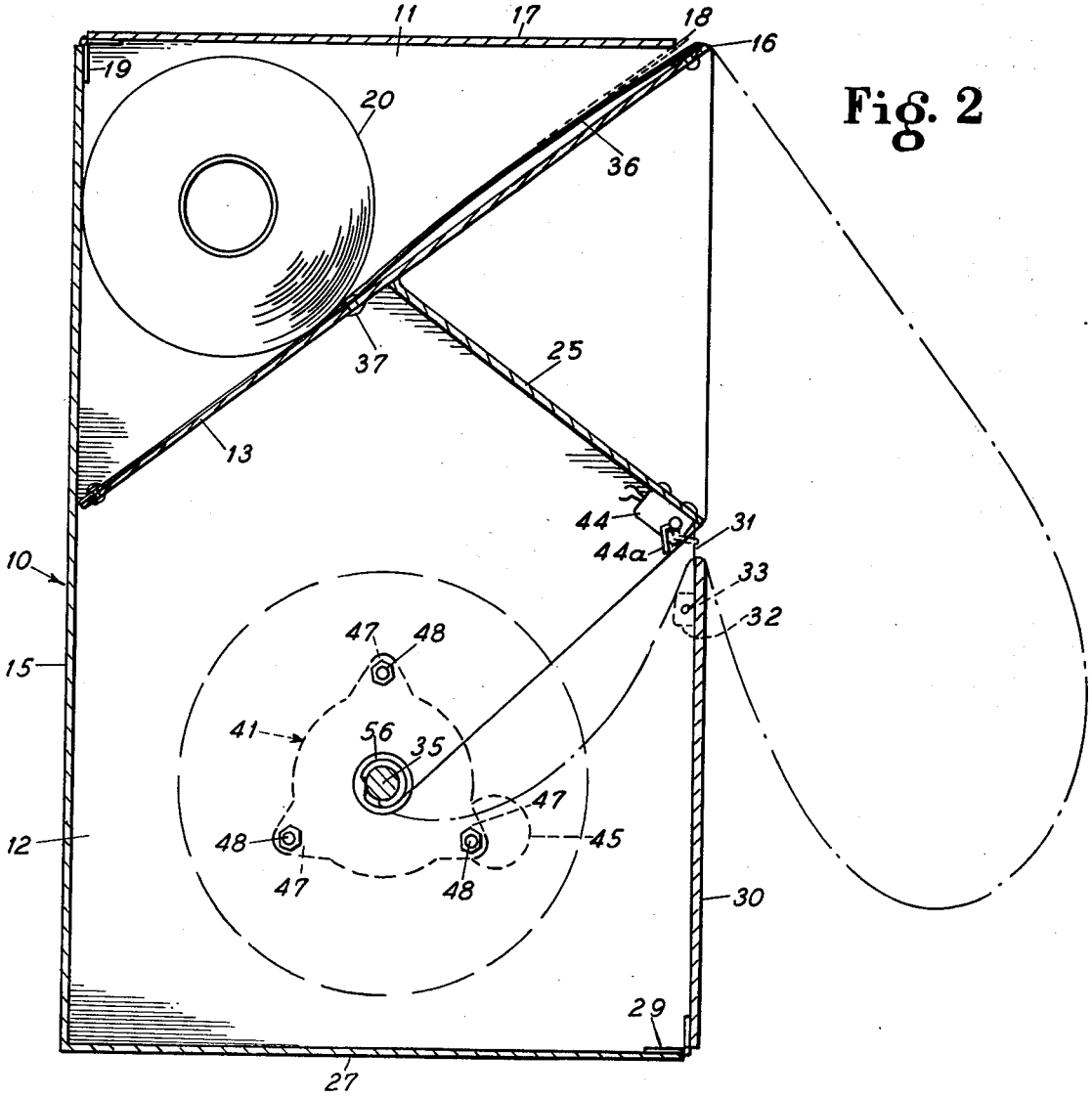
FIG. 2 is a transverse sectional view taken through the dispenser.

In the embodiment of the invention illustrated in FIGS. 1, 2 and 3 of the drawings, I have shown a cabinet 10 for dispensing commercial forms of rolled paper toweling commonly used in households and restrooms in restaurants and the like, for drying the face and hands, in which a roll of clean paper toweling 20 is supported in a clean towel compartment 11 in the top of the cabinet and is accessible from the front of the cabinet for use and rolled within a spent towel compartment 12 as used, separated from the clean towel compartment. A support plate 13 separates said compartments and extends from a rear wall of the cabinet in an upwardly inclined direction to an upper front portion 16 of the cabinet. While the plate 13 is shown as inclined, it may be contoured to cause the roll of paper resting thereon to bear against the back wall of the cabinet during unrolling of the paper. A hinged top 17 affords access to the clean towel compartment of the cabinet, and is shown as stopping short of the front 16 of the cabinet to form a slot 18 through which the clean toweling is dispensed. The top 17 is shown in FIG. 2 as being hinged to the inner side of the rear wall 15 of the cabinet at the top thereof as by spaced hinges 19 to afford access to the clean towel compartment of the cabinet and accommodate the insertion of a roll of clean paper toweling 20 therein and the initial training of the paper toweling through the slot 18.

The cabinet also has parallel side walls 21 and 22 extending to the top of the cabinet, and shown as having cut-away portions 23 and 24 respectively, conforming generally to the inclination of the plate 13 and a plate 25 extending thereacross to the underside of the plate 13, to which it may be welded or otherwise secured.

The cabinet further has a bottom plate 27 extending across the bottom of the cabinet and closing the bottom of the spent towel compartment 12 and forming a mounting at its front end for hinges 29 hinging a front plate 30 thereto. The front plate 30 extends upwardly along the side walls 21 and 22, along the outer ends thereof and stops short of the bottom of the inclined plate 25, to form a slot 31 for the insertion of spent, damp toweling into the cabinet. The hinged front plate 30 may have in-turned lugs 32 extending inwardly from opposite sides thereof along outsides of the side walls 21 and 22 and may be held in a closed position by a simple form of pin and aperture locking means illustrated generally by reference numeral 33, positively holding the spent towel compartment closed and accommodating ready opening of the spent towel compartment of the cabinet for access to said compartment to clip a leading end of the roll of paper to a winding spindle 35, or to remove a roll of spent toweling therefrom. The locking means need not necessarily be a pin and aperture lock, but may be a conventional form of detent lock or may be a latch if desired. The plate 30, however, should be positively held in its closed position, so it will not open during use.

As shown in FIG. 2, the roll of paper toweling 20 may be placed in the clean towel compartment of the cabinet by hinging the top plate 17 upwardly and may rest on the inclined plate 13 and the back wall 15 and trained along the top surface of the wall 13 over a sensing switch 36, herein shown as being a reed switch, and secured at its rear or inner end to the plate 13 by a suitable connector 37. Said connector and switch are suitably insulated from said top plate. Said connector may form a terminal for a conductor 39 (FIG. 5) leading from a battery 40, provided to establish the current to energize a winding motor 41, for driving the spindle 35 in a winding direction. The battery 40 may be a six volt dry cell battery and may be replaced by a converter and transformer if desired. The sensing switch 36 is shown as extending to the slot 18 along the top of the plate 13 for engagement with a contact 43, as long as paper toweling rests thereon, to complete an energizing circuit from the battery 40 to the motor 41 through a limit switch 44 and a cooperating time delay 45. The switch 36 need not necessarily be a reed switch but may be any form of switch sensitive enough to sense the weight of the paper thereon and termed a normally open switch since it only closes when paper toweling extends out of the slot 18. An electric eye may take the place of the reed switch if desired.

The limit switch 44 is shown in FIG. 2 as being mounted on the underside of the front end portion of the inclined plate 25 and as depending therefrom. The limit switch 44 may be of various forms and as shown in FIG. 2, has a switch arm **44*a* engaged by the paper toweling when the paper toweling is taut across the front recessed portion of the cabinet, as shown in FIG. 2 to open a circuit to the motor 41 and deenergize the circuit to said motor. Upon pulling on the paper toweling for use, from the taut position shown in FIG. 2 to the broken line position shown in this figure, the switch arm 44*a* will move to the normally closed position of the switch for a predetermined time interval sufficient to accommodate winding of the paper on the spindle 35. At the termination of this time delay interval, which may be 15 to 45 seconds or more, depending upon the use to which the toweling is to be placed and the time at which the time delay is set, the motor 41 will be energized to wind the moist, dirty toweling on the spindle 35. During this operation, the switch arm 44*a* will be moved by the taut paper toweling to the solid line position shown in FIG. 2, and open the switch 44. As soon as the paper toweling is withdrawn from the cabinet 10, by grasping opposite sides of the toweling in the recessed portion of the front wall of the cabinet, the limit switch 44 will move to its normally closed position to effect the winding of the spent toweling on the spindle 35 and stretching of the dry toweling across the recessed portion of the front wall of the cabinet, as shown by solid lines in FIG. 2. At this time, the taut paper toweling moves the switch arm 44*a* to the solid line position shown in FIG. 2 to open the circuit to the motor 41 under the control of the time delay relay 45**.

In FIG. 1, I have shown the motor 41 mounted on the side wall 22 and having a collar 46 extending thereabout and forming a base. As shown in FIG. 1, the base of said collar has feet 47 extending radially therefrom. The base 46 and feet 47 may be bolted or otherwise secured to said side wall as by nuts and bolts 48. The motor 41 may be a speed reducer motor, although it need not necessarily be such a motor and is shown as having a shaft 49 rotating at a low rate of speed, which may be in the order of 50 to 100 rpm and may be a commercial article of manufacture, so need not herein be shown or described in detail.

As shown in FIG. 3, the motor shaft 49 has a coupling 50 on the end thereof and extending therefrom. Said coupling 50 may be secured to the end of said shaft as by a drive pin 51, or any other suitable connecting means. The coupling 50 projects beyond the end of the motor shaft and has a coaxial socket 52 within which the drive end of the spindle 35 fits. As shown in FIGS. 3 and 4, the spindle has a flat portion 53 engageable with a flat portion of the coupling 50 to positively drive said spindle 35. The coupling also has diametrically opposed slotted portions 54 and 55 affording a means for receiving a clip 56, which may be a generally U-shaped spring clip. As shown in FIG. 4, the clip 56 has a leg 57 having an intermediate portion formed to fit within a groove 59 extending about said spindle and retaining the spindle 35 to the shaft 49, but accommodating ready removal of the spindle 35 from the shaft 49 when it is desired to remove a roll of paper toweling from the cabinet through the hinged front wall 30.

The spindle 35 also has a pair of spring clips 60 thereon for clipping the free end of the paper toweling thereto. The spring clips 60 may be C clips and may be made from plastic or of any other material which will not rust and has sufficient yieldability to clamp the end of the paper toweling to the spindle 35. The spindle 35 extends through a bearing support 61, herein shown as formed integrally with the side wall 21 and pressed inwardly therefrom to form a bearing support for the opposite end of said spindle from the motor 41. The spindle also has a head 62 disposed outside of the side wall 20, which may be grasped by the hand upon disconnection of said spindle from the shaft 49, by removal of the clip 56, to slide the spindle outwardly and remove the clips 60 from the end of said spindle by engagement with the bearing 61 to accommodate the roll of paper toweling to drop to the bottom plate 27 and be removed for disposal. The clips 60 may be removed from the roll of spent toweling by turning the toweling in an upright position and allowing said clips to drop through the center of the roll, it being understood that said clips are disconnected from the leading end of the roll by pulling the spindle outwardly for the full extent of its travel.

The battery 40 may be enclosed in a casing 63 suitably secured to the outside of the side wall 22 as by nuts and bolts 64 extending through lugs 65 projecting from opposite sides of said casing. The casing 63 may also form a casing for the time delay 45 and motor 41. The time delay relay may be an Amperite type of time delay, or a like form of time delay, suitable for delaying the time of energization of the motor 41 for a predetermined time interval and is of a commercial form so need not herein be shown or described in detail.

It may be seen from the foregoing that the paper toweling is always is position to be grasped by the hands and pulled outwardly of the dispenser to release the switch arm 44*a* to move to the dotted line position shown in FIG. 2 and effect closing of the switch 44 and energization of the motor 41 in a predetermined time interval sufficient to accommodate complete drying of the hands or hands and face and that as soon as the time delay interval has passed, the motor 41 will be energized to wind the toweling on the spindle 31 and bring the paper toweling taut across the recessed front portion of the dispenser casing and to move the switch 44 to its open position as shown in FIG. 2.

It may further be seen that the soiled or spent towel compartment 12 is separated from the clean towel compartment by the plates 13 and 25 to render the dispenser sanitary and prevent the contamination of the clean toweling in the cabinet and as disposed from the cabinet and that the entire dispenser is arranged with a view toward utmost simplicity, not only for use in commercial restrooms, but in the home if desired.

It should further be understood that the cabinet for the dispenser, while sectioned as made from metal, may be made from plastic or other suitable material, and may be formed in various ornamental shapes commensurate with the efficiency of the dispenser and is of a size which may be secured to the wall, with the paper toweling between the slots 18 and 31 readily accessible to the average individual.

I claim as my invention:

1. In a dispenser for roll paper toweling, a cabinet having an upper clean towel compartment and a lower spent towel compartment separated from said clean towel compartment, said cabinet also having front and rear walls and parallel side walls, a slot at the upper front portion of said cabinet for the withdrawal of clean toweling from said clean towel compartment, a slot spaced downwardly of said first slot for the insertion of spent toweling into said spent towel compartment, a recess for substantial depth between said slots to accommodate the grasping of clean toweling by the hands to withdraw clean toweling from said clean towel compartment, a spindle extending between said side walls across said spent towel compartment, means accommodating the attachment of spent paper toweling onto said spindle, a motor and a drive connection from said motor to said spindle, an energizing circuit for said motor deenergized by tension on the paper and energized as the paper toweling is withdrawn from said first slot for use, said energizing circuit including time delay switch means holding said motor from operation prior to winding spent toweling on said spindle for a time sufficient to accommodate drying of the spent paper toweling, said time delay switch having a switch arm adjacent said second slot and engaged by the paper as long as there is tension on the paper sufficient to maintain the paper taut across said recess.

2. The roll towel dispenser of claim 1, wherein the time delay switch is a normally closed switch and is opened by the tension of paper engaging said switch and includes a time delay relay in series with said switch.

3. The roll paper towel dispenser of claim 2, wherein the support wall for the clean toweling is an inclined wall extending upwardly from said rear wall to said first slot, a sensor switch extends along said inclined wall and has contacts adjacent said first slot closed by the weight of paper thereon to complete an energizing circuit to said motor through said time delay switch as paper is withdrawn from said clean towel compartment, to effect the winding of spent paper toweling on said spindle.

4. The paper towel dispenser of claim 3, in which the sensor switch is a reed switch secured to said inclined wall and extending therealong to a position adjacent said first mentioned slot, to be closed by the weight of paper toweling thereon as withdrawn from said first mentioned slot.

5. The roll towel dispenser of claim 4, wherein said time delay switch is biased to a closed position and is disposed adjacent said second mentioned slot and has a switch arm actuated by tension on the paper towel, to effect opening of said switch as paper toweling is wound on said spindle to a taut position between said spindle and said first and second mentioned slots.

6. The roll paper towel dispenser of claim 5, including a second inclined wall extending angularly downwardly from the underside of said first inclined wall and with said first inclined wall, forms said recess between said slots.

7. The roll paper towel dispenser of claim 6, wherein the means accommodating the attachment of spent paper toweling onto said spindle comprises clip means yieldably connected with said spindle and removable to disconnect the paper toweling from said spindle upon axial withdrawl of said spindle relative to said drive connection from said motor.

8. The roll paper towel dispenser of claim 7, wherein the drive connection from said motor to said spindle is a detachable coupling.

9. The roll paper towel dispenser of claim 8, wherein the motor includes a shaft extending within the spent towel compartment, the coupling is secured to said shaft, and a yieldable detachable U-shaped connection is provided to detachably connect said spindle to said coupling.

10. The roll paper towel dispenser of claim 9, wherein said spindle is supported for rotation within said cabinet and is axially movable relative to said cabinet to accommodate removal of the roll of spent toweling from said spindle and the front wall of said spent towel compartment is a hinged wall latched in an upright position and unlatched to accommodate the disposal of spent toweling through said hinged front wall.

* * * * *